US008353343B2

(12) United States Patent
Seaba et al.

(10) Patent No.: US 8,353,343 B2
(45) Date of Patent: Jan. 15, 2013

(54) HYDROCARBON PRODUCTION PROCESS

(75) Inventors: James P. Seaba, Bartlesville, OK (US); Thomas J. Wheeler, Houston, TX (US); David C. LaMont, Calgary (CA); Edward G. Latimer, Ponca City, OK (US)

(73) Assignee: ConocoPhillips Company, Houston, TX (US)

( * ) Notice: Subject to any disclaimer, the term of this patent is extended or adjusted under 35 U.S.C. 154(b) by 385 days.

(21) Appl. No.: 12/721,301

(22) Filed: Mar. 10, 2010

(65) Prior Publication Data

US 2010/0230097 A1 Sep. 16, 2010

Related U.S. Application Data

(60) Provisional application No. 61/160,144, filed on Mar. 13, 2009.

(51) Int. Cl.
*E21B 43/24* (2006.01)

(52) U.S. Cl. ..... 166/272.3; 166/303

(58) Field of Classification Search ..... 166/272.1, 166/302, 303, 272.3
See application file for complete search history.

(56) References Cited

U.S. PATENT DOCUMENTS

| | | | | |
|---|---|---|---|---|
| 4,604,988 | A | 8/1986 | Rao | |
| 4,648,835 | A | 3/1987 | Eisenhawer | |
| 5,611,219 | A * | 3/1997 | Bonaquist | 62/646 |
| 5,758,605 | A | 6/1998 | Calkins | |
| 6,170,264 | B1 * | 1/2001 | Viteri et al. | 60/671 |
| 6,206,684 | B1 | 3/2001 | Mueggenburg | |
| 6,389,814 | B2 | 5/2002 | Viteri | |
| 7,293,532 | B2 | 11/2007 | Reinhardt | |
| 8,091,625 | B2 * | 1/2012 | Ware et al. | 166/59 |
| 2004/0050067 | A1 * | 3/2004 | Sprouse et al. | 60/774 |
| 2007/0193748 | A1 * | 8/2007 | Ware et al. | 166/303 |
| 2007/0202452 | A1 | 8/2007 | Rao | |
| 2010/0224363 | A1 * | 9/2010 | Anderson et al. | 166/266 |

* cited by examiner

*Primary Examiner* — Jennifer H Gay
*Assistant Examiner* — Catherine Loikith
(74) *Attorney, Agent, or Firm* — ConocoPhillips Company

(57) ABSTRACT

Methods and apparatus relate to producing hydrocarbons. Injecting a fluid mixture of steam and carbon dioxide into a hydrocarbon bearing formation facilitates recovery of the hydrocarbons. Further, limiting amounts of non-condensable gases in the mixture may promote dissolving of the carbon dioxide into the hydrocarbons upon contact of the mixture with the hydrocarbons.

19 Claims, 2 Drawing Sheets

HYDROCARBON PRODUCTION PROCESS

CROSS-REFERENCE TO RELATED APPLICATIONS

None

STATEMENT REGARDING FEDERALLY SPONSORED RESEARCH OR DEVELOPMENT

None

FIELD OF THE INVENTION

Embodiments relate to production of hydrocarbons from an underground formation.

BACKGROUND OF THE INVENTION

Conventional processes for production of heavy hydrocarbons from heavy oil or bitumen containing formations utilize energy and cost intensive techniques. Expense of producing steam through indirect steam generation and expensive boiler feed water preparation contribute to inefficiencies in such techniques. Therefore, a need exists for improved processes for efficient production of heavy hydrocarbons from a formation.

SUMMARY OF THE INVENTION

In one embodiment, a method of producing hydrocarbons includes supplying an oxygen stream from a cryogenic air separation unit to a direct steam generator, combusting a fuel stream with the oxygen stream in the direct steam generator and in presence of water to provide an output stream from the direct steam generator, injecting the output stream into a formation to contact and heat hydrocarbons in the formation. The method further includes recovering the hydrocarbons that have been heated. In addition, the cryogenic air separation unit provides the oxygen stream with a limited content of non-condensable gases such that recovering of the hydrocarbons is facilitated.

According to one embodiment, a method of producing hydrocarbons includes supplying an oxygen stream to a direct steam generator and combusting a fuel stream with the oxygen in the direct steam generator and in presence of water to provide an output stream from the direct steam generator. Further, the method includes injecting the output stream into a formation to contact and heat hydrocarbons in the formation and recovering the hydrocarbons that have been heated. The output stream contains less than 0.9 volume percent of non-condensable gases to facilitate with the recovering of the hydrocarbons.

For one embodiment, a production system for producing hydrocarbons includes a cryogenic air separation unit capable of supplying an oxygen stream, a direct steam generator coupled to receive the oxygen stream and a fuel stream for combustion with the oxygen stream in presence of water to provide an output stream from the direct steam generator, and an injector configured to convey the output stream into a formation to contact and heat hydrocarbons in the formation. A recovery system produces the hydrocarbons that are heated. The cryogenic air separation unit provides the oxygen stream with a limited content of non-condensable gases to facilitate with recovering of the hydrocarbons.

BRIEF DESCRIPTION OF THE DRAWINGS

The invention, together with further advantages thereof, may best be understood by reference to the following description taken in conjunction with the accompanying drawings.

DETAILED DESCRIPTION OF THE INVENTION

Embodiments of the invention relate to producing hydrocarbons. Injecting a fluid mixture of steam and carbon dioxide into a hydrocarbon bearing formation facilitates recovery of the hydrocarbons. Further, limiting amounts of non-condensable gases in the mixture may promote dissolving of the carbon dioxide into the hydrocarbons upon contact of the mixture with the hydrocarbons.

As used herein, heavy hydrocarbons of hydrocarbon formation(s) can include any heavy hydrocarbons having greater than 10 carbon atoms per molecule. Further, the heavy hydrocarbons of the hydrocarbon formation can be a heavy oil having a viscosity in the range of from about 100 to about 10,000 centipoise, and an API gravity less than or equal to about 22° API; or can be a bitumen having a viscosity greater than about 10,000 centipoise, and an API gravity less than or equal to about 22° API.

Figure 1:
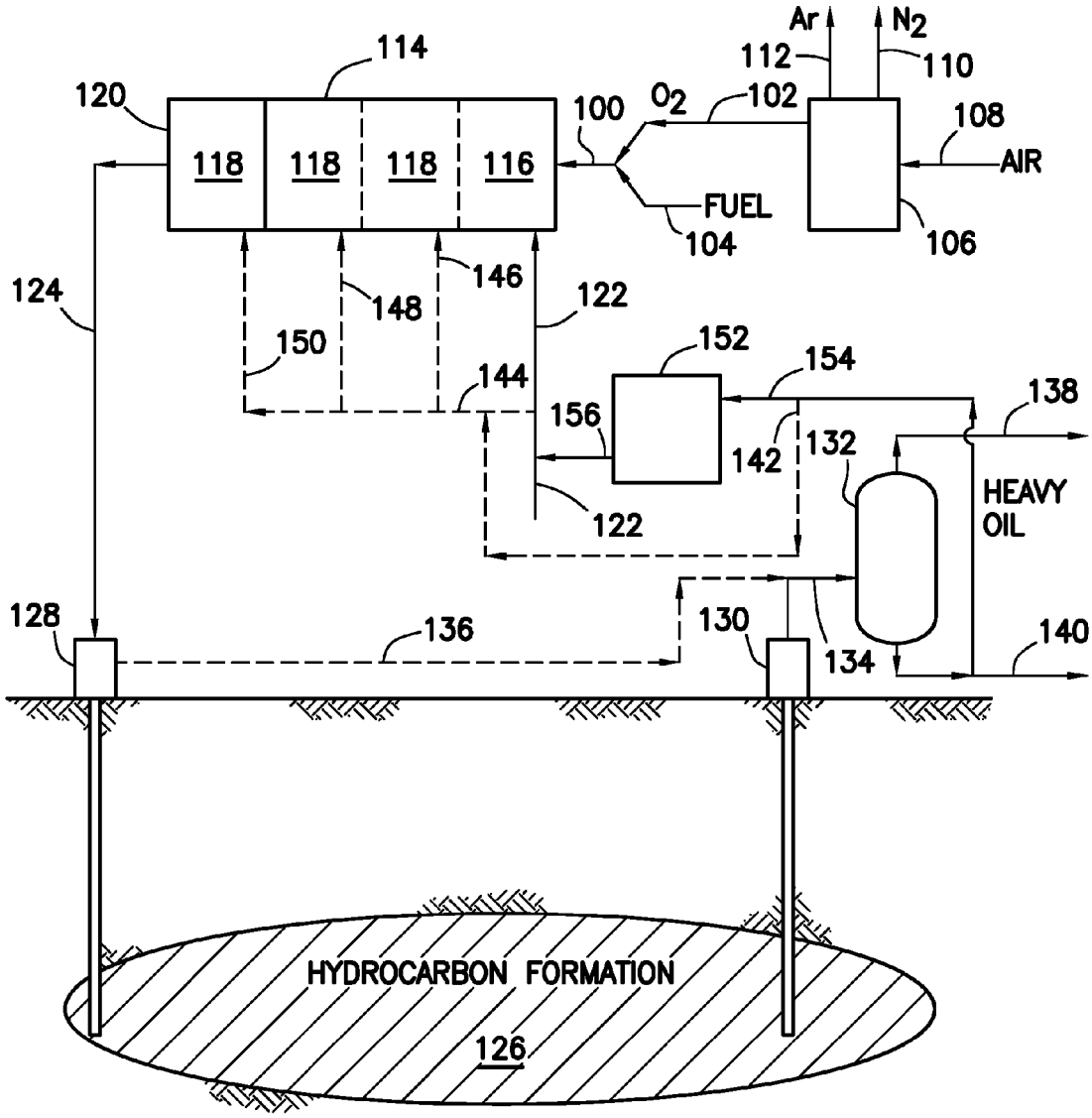
FIG. 1 is a simplified schematic flow diagram of a hydrocarbon recovery system utilizing a direct steam generator, according one embodiment of the invention.

FIG. 1 illustrates a hydrocarbon production process utilizing an air separation unit 106 and a direct steam generator 114 coupled to provide an exhaust stream to an injection well 128. For some embodiments, the air separation unit 106 provides an oxygen stream of at least about 94% oxygen or at least about 99% oxygen, on a dry gas basis, to a combined conduit 100 via an oxidant conduit 102 for mixture with a fuel gas stream charged to the combined conduit 100 via a fuel conduit 104. The fuel gas stream in some embodiments includes a fuel selected from at least one of hydrogen and hydrocarbons having from one to five carbon atoms per molecule. Mixing of the oxygen and fuel streams thereby forms a combustible mixture comprising, consisting of, or consisting essentially of hydrocarbons, oxygen and less than 0.9 volume percent (vol %) or less than about 0.5 vol %, on a dry gas basis, of nitrogen and/or argon. As described further herein, non-condensable gases such as nitrogen and argon can inhibit recovery of the hydrocarbons.

In some embodiments, an air stream comprising oxygen, nitrogen and argon can be charged to an air separation unit 106 via air supply conduit 108 for removal of nitrogen and argon via nitrogen and argon exhaust conduits 110 and 112, respectively, from the air stream thereby forming the oxygen stream removed from the air separation unit 106 via the oxidant conduit 102. With reference to the Examples herein, selection of the air separation unit 106 enables achieving desired purity of oxygen with selected thresholds of the non-condensable gases. Non-condensable gases as defined herein include gases having a boiling point lower than oxygen. Such selection of the air separation unit 106 provides direct influence on the non-condensable gases that are injected through the injection well 128.

For some embodiments, the direct steam generator 114 includes a combustion zone 116, a plurality of mixing zones 118 downstream from the combustion zone 116, and an exhaust barrel 120 downstream from the mixing zones 118. The combustible mixture and a clean water stream comprising, consisting of, or consisting essentially of liquid water and less than about 100 ppm, less than about 20 ppm, or less than about 10 ppm total dissolved solids are charged to the combustion zone 116 via the combined conduit 100 and a clean water conduit 122, respectively. In some embodiments, the direct steam generator includes at least two, at least four, or at least six of the mixing zones 118 for injection, at discrete progressive downstream locations from the combustion zone 116, of water having more impurities than the clean water stream supplied by the clean water conduit 122. As an example, a direct steam generator such as that described in U.S. Pat. No. 6,206,684 (assigned to Clean Energy Systems and incorporated herein by reference in its entirety) can be used or modified in an appropriate manner to include the mixing zones 118.

Combustion zone effluent forms once the fuel stream is combusted and the water is converted from liquid to steam. The combustion zone effluent is then allowed to mix downstream in the mixing zones 118. A steam conduit 124 removes an exhaust stream from the exhaust barrel 120 of the steam generator 114. The exhaust stream is at a pressure in the range of from about 1,000 to about 20,000 kPag.

The exhaust stream comprises, consists of, or consists essentially of $CO_2$ and steam. Amount of non-condensable gases in the exhaust stream thus depends on quality and/or type of the fuel stream and aforementioned oxygen purity of the oxygen stream. The exhaust stream comprises, consists of, or consists essentially of $CO_2$, steam, and less than 0.9 vol % or less than about 0.5 vol %, on a dry gas basis, of nitrogen and/or argon. For some embodiments, the exhaust stream comprises, consists of, or consists essentially of in the range of from about 0.5 to about 20 vol %, or about 1 to about 10 vol %, or about 4 to about 6 vol % $CO_2$; in the range of from about 80 to about 99.5 vol %, about 90 to about 99 vol %, or about 94 to about 96 vol % steam, and less than 0.9 vol % or less than about 0.5 vol %, on a dry gas basis, non-condensable gases.

At least a portion of the exhaust stream is injected into a hydrocarbon formation 126 via the steam conduit 124 and the injection well 128 drilled into the hydrocarbon formation 126 for contact with the heavy hydrocarbons in the hydrocarbon formation. At least a portion of the $CO_2$ of the exhaust stream dissolves into at least a portion of the heavy hydrocarbons of the formation forming $CO_2$-enriched heavy hydrocarbons having a lower viscosity than the heavy hydrocarbons. At least a portion of the steam of the exhaust stream condenses at the interface of the exhaust stream and the $CO_2$-enriched heavy hydrocarbons forming a condensate and transferring heat to at least a portion of the $CO_2$-enriched heavy hydrocarbons, thereby liquefying at least a portion of the $CO_2$-enriched heavy hydrocarbons to form liquefied $CO_2$-enriched heavy hydrocarbons. The condensation of the steam also results in a higher $CO_2$ partial pressure for the exhaust stream at the interface between the exhaust stream and the $CO_2$-enriched heavy hydrocarbons than the $CO_2$ partial pressure of the exhaust stream as injected into the hydrocarbon formation.

As concentration limits of non-condensable gases in the exhaust stream injected into the hydrocarbon formation 126 is lowered, $CO_2$ partial pressure at the interface increases between the exhaust stream and the heavy hydrocarbons. Maintaining appropriate limits on the concentration of the non-condensable gases may thus facilitate with $CO_2$ being dissolved into the heavy hydrocarbons.

Recovery processes can operate in cyclic mode wherein the exhaust stream is injected into the hydrocarbon formation 126, allowed to remain in the hydrocarbon formation 126 for a period of time (weeks to months), and then removed from the hydrocarbon formation 126. When operating in the cyclic mode, a production stream comprising, consisting of, or consisting essentially of at least a portion of the condensate and at least a portion of the liquefied $CO_2$-enriched heavy hydrocarbons can be removed from the hydrocarbon formation 126 via the injection well 128, or via a production well 130 drilled into the hydrocarbon formation 126. A portion of the production stream can comprise an emulsion of at least a portion of the condensate and at least a portion of the liquefied $CO_2$-enriched heavy hydrocarbons. The processes can also operate in a continuous mode wherein the exhaust stream is injected into the hydrocarbon formation 126 via the injection well 128, and the production stream is removed from the hydrocarbon formation 126 via the production well 130.

The production stream is charged to an oil water separator unit 132 via production conduit 134 (and 136 for the cyclic mode of operation) for separation into a hydrocarbon product stream and into a dirty water stream. A product conduit 138 removes the hydrocarbon product stream from the oil water separator unit 132. Further, an untreated water conduit 140 removes the dirty water stream from the oil water separator unit 132. The dirty water stream comprises, consists of, or consists essentially of liquid water and at least about 1,000 ppm, or at least about 5,000 ppm, or at least about 10,000 ppm total dissolved solids. In some embodiments, at least a portion of the dirty water stream from the untreated water conduit 140 is charged to at least one of the mixing zones 118 via dirty water input conduits 142, 144, 146, 148 and 150 such that the liquid water of the dirty water stream is converted to steam and is mixed with the combustion zone effluent in the mixing zones 118. The dirty water supplied to the mixing zones 118 may undergo no treatment or treatment or filtering that removes fewer impurities than are removed to create the clean water stream.

For some embodiments, at least a portion of the dirty water stream can be charged to a water treatment unit 152 via water treatment input conduit 154 for removal of total dissolved solids, thereby forming the clean water stream. The clean water stream may include less than about 100 ppm, or less than about 20 ppm, or less than about 10 ppm total dissolved solids. The clean water stream is removed from the water treatment unit 152 via treated water output conduit 156 and is injected into the clean water conduit 122 for aforementioned use in the steam generator 114. In some embodiments, a portion of the clean water stream can be charged to at least one of the mixing zones 118. Each of the mixing zones 118 can thereby have an associated inlet for introduction of at least a portion of the dirty water stream and/or for introduction of at least a portion of the clean water stream.

The following example is provided to further illustrate this invention and is not to be considered as unduly limiting the scope of this invention.

EXAMPLES

Five separate heavy oil recovery simulations of steam assisted gravity drainage (SAGD) were performed using a thermal reservoir simulation model. Simulations 1-3 represented embodiments of the invention while simulations 4 and 5 were comparative. The reservoir operational pressure and temperature used in the simulations were 4,000 kPag, and 250° C. (the saturated temperature), respectively. The in situ heavy oil viscosity and API gravity values used in the simulations were 770,000 centipoise and 10° API, respectively. Other simulation model parameter values for the five simulations are presented in the Table below with results of the simulations shown graphically in FIG. 2.

TABLE

| | Exhaust Stream | | |
|---|---|---|---|
| Simulation | Steam (vol %) | $CO_2$ (vol %) | NCG (vol %) |
| 1 | 95 | 4.95 | 0.05 |
| 2 | 95 | 5 | 0 |
| 3 | 95 | 4.5 | 0.5 |
| 4 | 95 | 4.1 | 0.9 |
| 5 | 100 | 0 | 0 |

Simulation 5 was for an injection of pure steam (e.g., obtainable by use of indirect steam generation in a boiler) down hole in the SAGD process. The pure steam demonstrated faster recovery than any other simulations performed. However, utilizing boilers to generate steam requires, relative to direct steam generation, more space to accommodate boiler footprint, more water use, a higher overall steam to oil ratio resulting in higher costs, and more fuel consumption per pound of steam produced. Simulations 1 through 4 modeled situations with varying amounts of non-condensable gases (NCG's; e.g., $N_2$ and Ar) and $CO_2$ introduced with the steam. Introduction of the NCG showed that the NCG resulted in a negative impact on rate of recovery of oil adding significant time to the recovery of the oil.

Figure 2:
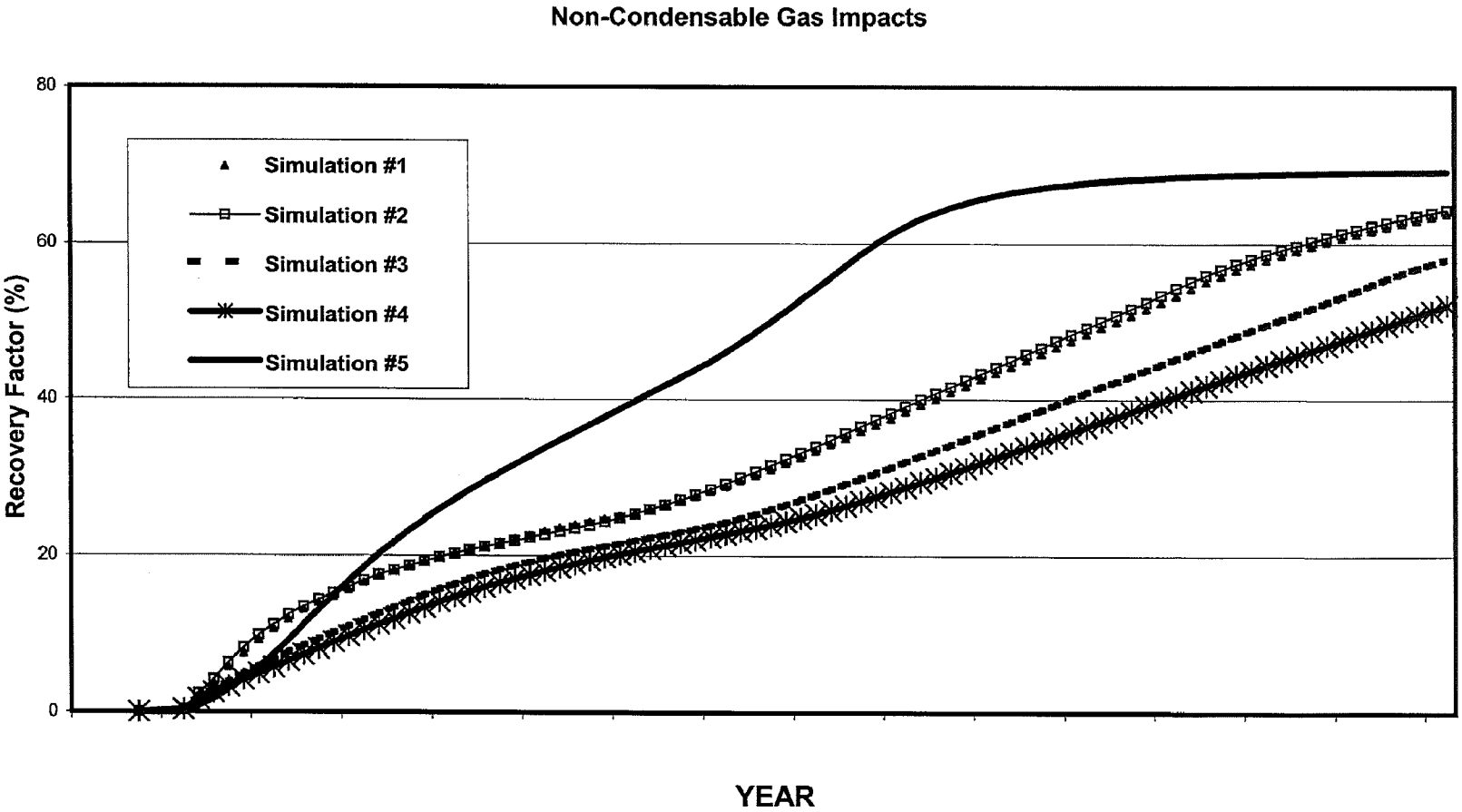
FIG. 2 is a graphic illustration of data for oil recovery versus time obtained from a thermal reservoir simulation model for five separate simulations (three simulations according to embodiments of the invention and two comparative simulations), simulating heavy oil recovery from a heavy oil containing formation.

As shown in FIG. 2, the simulation results indicated that the oil recovery for simulation 2 (with 95 volume percent (vol %) steam, 5 vol % $CO_2$, and 0 vol % NCG) was slightly higher than the oil recovery for simulation 1 (with 95 vol % steam, 4.95 vol % $CO_2$, and 0.05 vol % NCG). Comparison of simulations 1 and 2 showed that even a slight increase in non-condensable gas volume % in the exhaust stream had an adverse affect on heavy oil recovery. The oil recovery for simulations 1 and 2 were higher than that for simulation 3, which included 0.5 vol % NCG. Also, comparative simulation 4, with 0.9 vol % NCG, resulted in substantially lower heavy oil recovery than that for simulations 1-3. Thus, these simulations indicated that increasing the NCG vol % by just 0.4 vol % (comparing simulations 3 and 4) substantially inhibited oil recovery.

In order to achieve desirable levels of the NCGs, the air separation unit 106 depicted in FIG. 2 defines a cryogenic based system (i.e., a cryogenic air separation unit) that supplies the direct steam generator 114 in some embodiments. The air separation unit 106 compresses and cools the air to about −185° C. and then separates the $O_2$ out from other components of the air by cryogenic fractional distillation since the $O_2$ has a different boiling point than the other components, such as argon and nitrogen. Unlike use of a non-cryogenic air separation unit as represented by simulation 4 with 0.9 vol % NCG in output streams from subsequent steam generation, the cryogenic air separation unit provides ability to produce oxygen streams that have sufficient low nitrogen and argon concentrations for inputting into the direct steam generator to achieve less than 0.9 vol % NCG in the exhaust stream from the steam generator 114.

The 0.05 vol % NCG of simulation 1 represents the output stream of the steam generator 114 when supplied with oxygen from a high purity cryogenic air separation unit that delivers 99.5 vol % pure $O_2$ and includes an argon tower for facilitating purification of the $O_2$. Even if the high purity cryogenic air separation unit does not contribute to any of the 0.05 vol % NCG in the output stream, impurities in the fuel stream may limit reduction of nitrogen levels below the 0.05 vol % NCG in the output stream. Further, the 0.5 vol % NCG of simulation 3 represents the output stream of the steam generator when supplied with oxygen from a low purity ASU (lacking an argon tower) that delivers 95 vol % pure $O_2$. The low purity ASU does not have adequate distillation capacity to separate the argon and remaining nitrogen thereby increasing the NCGs up to the 0.5 vol % level.

The $CO_2$ injected with the steam for contact with the hydrocarbons in order to dissolve into the hydrocarbons may come from or be supplemented from sources other than processes used in generation of the steam. Some embodiments take $CO_2$ from pipeline or other capture waste sources and inject the $CO_2$ with steam to further improve results described herein. For example, a stream of $CO_2$ purified and captured for storage may mix with steam from a conventional boiler system prior to injection.

The preferred embodiment of the present invention has been disclosed and illustrated. However, the invention is intended to be as broad as defined in the claims below. Those skilled in the art may be able to study the preferred embodiments and identify other ways to practice the invention that are not exactly as described herein. It is the intent of the inventors that variations and equivalents of the invention are within the scope of the claims below and the description, abstract and drawings are not to be used to limit the scope of the invention.

The invention claimed is:

1. A method comprising the steps of:

supplying an oxygen stream from a cryogenic air separation unit to a direct steam generator;

combusting a fuel stream with the oxygen stream in the direct steam generator and in presence of water to provide an output stream from the direct steam generator;

injecting the output stream into a formation to contact and heat hydrocarbons in the formation, and recovering the hydrocarbons that have been heated, wherein the cryogenic air separation unit provides the oxygen stream with a limited content of non-condensable gases such that recovering of the hydrocarbons is facilitated.

2. The method according to claim 1, wherein the output stream from the direct steam generator contains less than 0.9 volume percent non-condensable gases.

3. The method according to claim 1, wherein facilitating recovering of the hydrocarbons includes promoting dissolving of carbon dioxide into the hydrocarbons upon contact of the output stream with the hydrocarbons.

4. The method according to claim 1, wherein the output stream from the direct steam generator contains less than about 0.5 volume percent of non-condensable gases.

5. The method according to claim 1, wherein the output stream from the direct steam generator contains less than about 0.05 volume percent of non-condensable gases.

6. The method according to claim 1, wherein the cryogenic air separation unit is a low-purity cryogenic air separation unit.

7. The method according to claim 1, wherein the fuel and oxygen streams are mixed in the steam generator with a first water feed prior to combusting and a second water feed containing more impurities than the first water feed is introduced into the output stream downstream of the combusting.

8. The method according to claim 1, wherein the output stream from the direct steam generator includes between 1.0 volume percent carbon dioxide and 10.0 volume percent carbon dioxide.

9. The method according to claim 1, wherein the output stream from the direct steam generator contains less than 0.9 volume percent of argon and nitrogen and between 1.0 volume percent carbon dioxide and 10.0 volume percent carbon dioxide.

10. A method comprising the steps of:

supplying an oxygen stream to a direct steam generator;

combusting a fuel stream with the oxygen in the direct steam generator and in presence of water to provide an output stream from the direct steam generator;

injecting the output stream into a formation to contact and heat hydrocarbons in the formation upon condensation within the formation of steam contained in the output stream; and recovering the hydrocarbons that have been heated, wherein the output stream contains less than 0.9 volume percent of non-condensable gases to facilitate with the recovering of the hydrocarbons.

11. The method according to claim 10, wherein facilitating recovering of the hydrocarbons includes promoting dissolving of carbon dioxide into the hydrocarbons upon contact of the output stream with the hydrocarbons.

12. The method according to claim 10, wherein the output stream from the direct steam generator contains less than about 0.5 volume percent of non-condensable gases.

13. The method according to claim 10, wherein the oxygen stream is from a cryogenic air separation unit.

14. The method according to claim 10, wherein the output stream from the direct steam generator includes between 1.0 volume percent carbon dioxide and 10.0 volume percent carbon dioxide.

15. A system comprising:

a cryogenic air separation unit capable of supplying an oxygen stream;

a direct steam generator coupled to receive the oxygen stream and a fuel stream for combustion with the oxygen stream in presence of water to provide an output stream from the direct steam generator;

an injector configured to convey the output stream into a formation to contact and heat hydrocarbons in the formation, and a recovery system to produce the hydrocarbons that are heated, wherein the cryogenic air separation unit provides the oxygen stream with a limited content of non-condensable gases to facilitate with recovering of the hydrocarbons.

16. The system according to claim 15, wherein the cryogenic air separation unit is configured to produce the oxygen stream with less than about 0.5 volume percent of non-condensable gases.

17. The system according to claim 15, wherein the cryogenic air separation unit is configured to produce the oxygen stream with less than 0.9 volume percent of non-condensable gases.

18. The system according to claim 15, wherein the direct steam generator includes a combustion chamber with inputs to mix the fuel and oxygen streams and a first water feed and a mixing region downstream of the combustion chamber with inputs to introduce a second water feed containing more impurities than the first water feed into the output stream downstream of the combustion chamber.

19. The system according to claim 15, wherein the fuel and oxygen stream are selected such that the output stream from the direct steam generator includes between 1.0 volume percent carbon dioxide and 10.0 volume percent carbon dioxide.

* * * * *